US010695605B2

(12) United States Patent
Grant

(10) Patent No.: US 10,695,605 B2
(45) Date of Patent: Jun. 30, 2020

(54) TOTEABLE TREADSTEP

(71) Applicant: Kelli Grant, Longvew, TX (US)

(72) Inventor: Kelli Grant, Longvew, TX (US)

( * ) Notice: Subject to any disclaimer, the term of this patent is extended or adjusted under 35 U.S.C. 154(b) by 0 days.

(21) Appl. No.: 15/414,350

(22) Filed: Jan. 24, 2017

(65) Prior Publication Data

US 2017/0128770 A1 May 11, 2017

Related U.S. Application Data

(60) Provisional application No. 62/293,631, filed on Feb. 10, 2016.

(51) Int. Cl.

| | |
|---|---|
| ***A63B 22/00*** | (2006.01) |
| ***A63B 22/02*** | (2006.01) |
| ***A63B 23/04*** | (2006.01) |
| *A63B 69/00* | (2006.01) |
| *A63B 21/00* | (2006.01) |
| *A63B 21/068* | (2006.01) |

(52) U.S. Cl.

CPC ..... *A63B 22/0285* (2013.01); *A63B 23/0458* (2013.01); *A63B 21/00047* (2013.01); *A63B 21/068* (2013.01); *A63B 21/4034* (2015.10); *A63B 22/001* (2013.01); *A63B 23/0405* (2013.01); *A63B 69/0057* (2013.01); *A63B 2210/50* (2013.01)

(58) Field of Classification Search

CPC ..... A63B 22/02
USPC ..... 482/54, 52
See application file for complete search history.

(56) References Cited

U.S. PATENT DOCUMENTS

| | | | | | |
|---|---|---|---|---|---|
| 767,221 | A * | 8/1904 | Hagen | A63B 22/02 | 482/54 |
| 931,394 | A * | 8/1909 | Day | A63B 22/02 | 482/54 |
| 1,064,968 | A * | 6/1913 | Hagen | A63B 22/02 | 482/54 |
| 1,748,425 | A * | 2/1930 | Odell | A61H 15/00 | 601/115 |
| 4,757,987 | A * | 7/1988 | Allemand | A63B 22/02 | 482/54 |
| 5,207,622 | A * | 5/1993 | Wilkinson | A63B 22/0012 | 482/118 |
| 5,393,287 | A * | 2/1995 | Papapaschalis | A61H 15/00 | 482/142 |
| 5,407,408 | A * | 4/1995 | Wilkinson | A63B 22/0012 | 482/147 |
| 5,429,563 | A * | 7/1995 | Engel | A63B 21/015 | 482/51 |

(Continued)

*Primary Examiner* — Joshua T Kennedy

(57) ABSTRACT

A non-mechanical manual combination treadmill/step deck exercise device comprises a treadmill having a strut beam frame with multiple spaced rods with equally dimensioned pipe rollers threaded thereon creating manually operated foot rotatably surface. A step deck conversion simulating a stair climbing workout comprises positioning a deck platform between opposite strut beams over said rollers. The step deck conversion unit is selectively in an operative location with treadmill in a storage location. Swing handles operative in handle assembly mounted to front exterior sides of strut beams of the treadmill foot contact surface pivoting the handles back and forth and thereby provide an arm movement simultaneously with the use of the leg exercise.

5 Claims, 12 Drawing Sheets

(56) References Cited

U.S. PATENT DOCUMENTS

| | | | | |
|---|---|---|---|---|
| 5,711,745 | A * | 1/1998 | Yang | A63B 22/02 482/51 |
| 6,132,343 | A * | 10/2000 | Eze | A63B 21/0615 482/97 |
| 7,862,489 | B2 * | 1/2011 | Sav(hacek over (s)ek | A63B 21/0455 482/121 |
| 8,740,756 | B2 * | 6/2014 | Shabodyash | A63B 22/02 482/51 |
| 2017/0246524 | A1 * | 8/2017 | Zapirain Elosegui | A63B 69/16 |
| 2017/0266483 | A1 * | 9/2017 | Dalebout | A63B 22/0285 |

* cited by examiner

Figure #1:
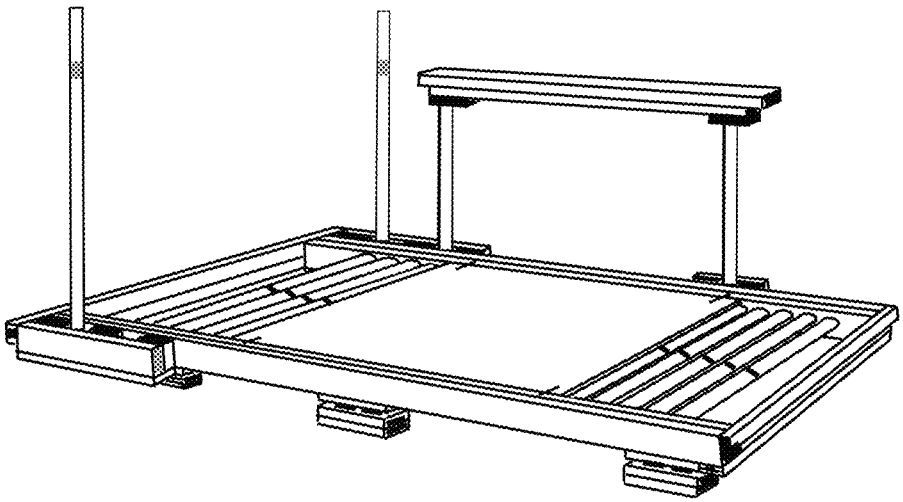

Figure #2:
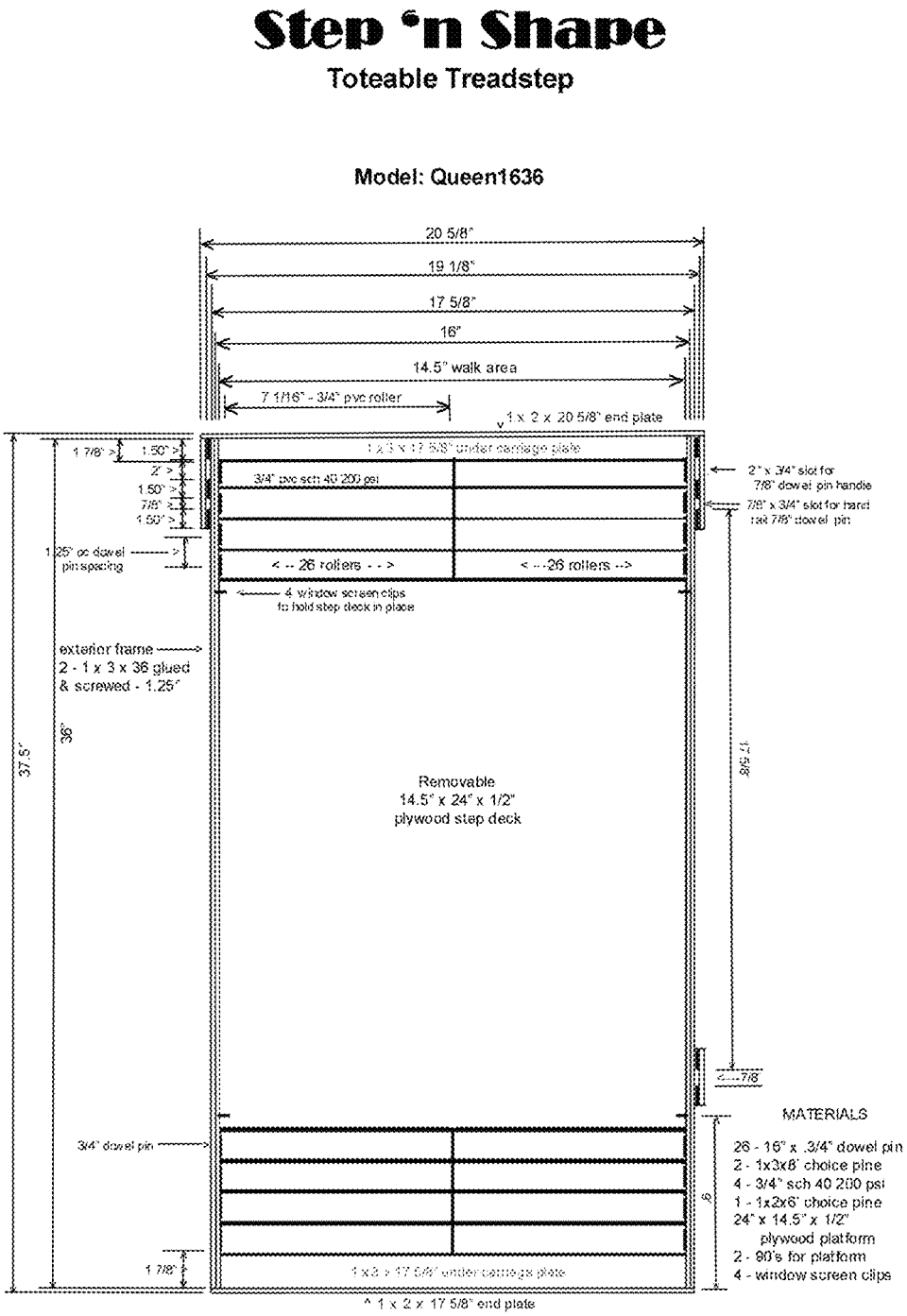

Figure #3:
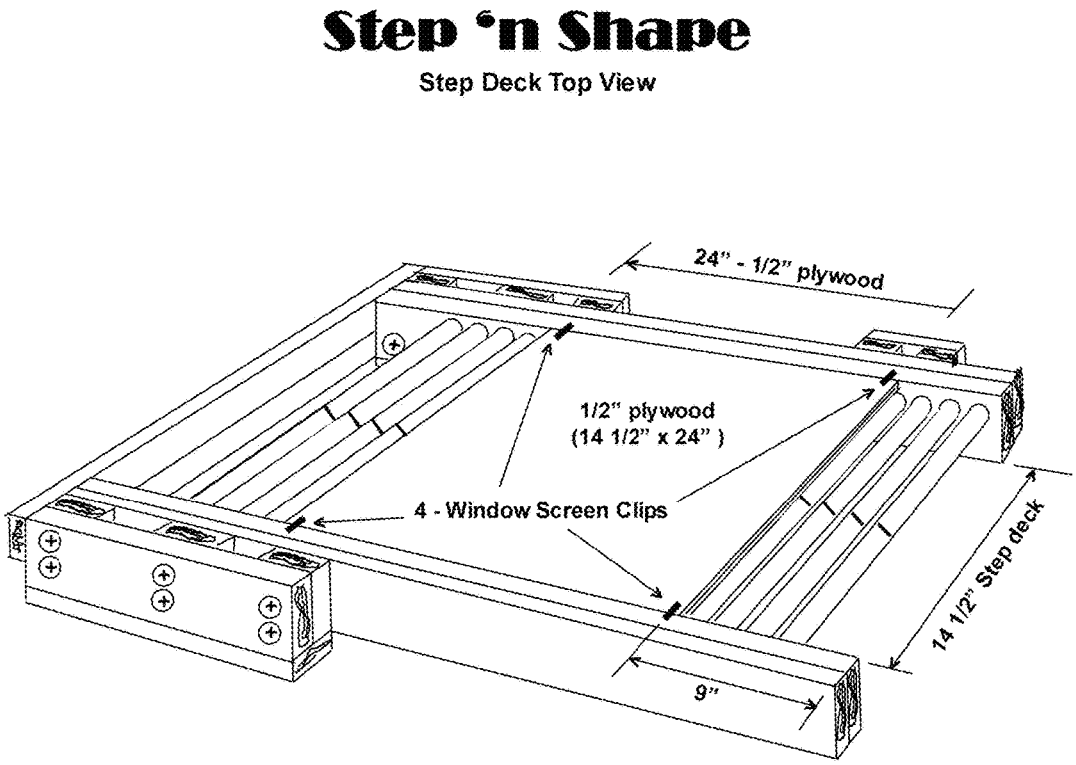

Figure #4:
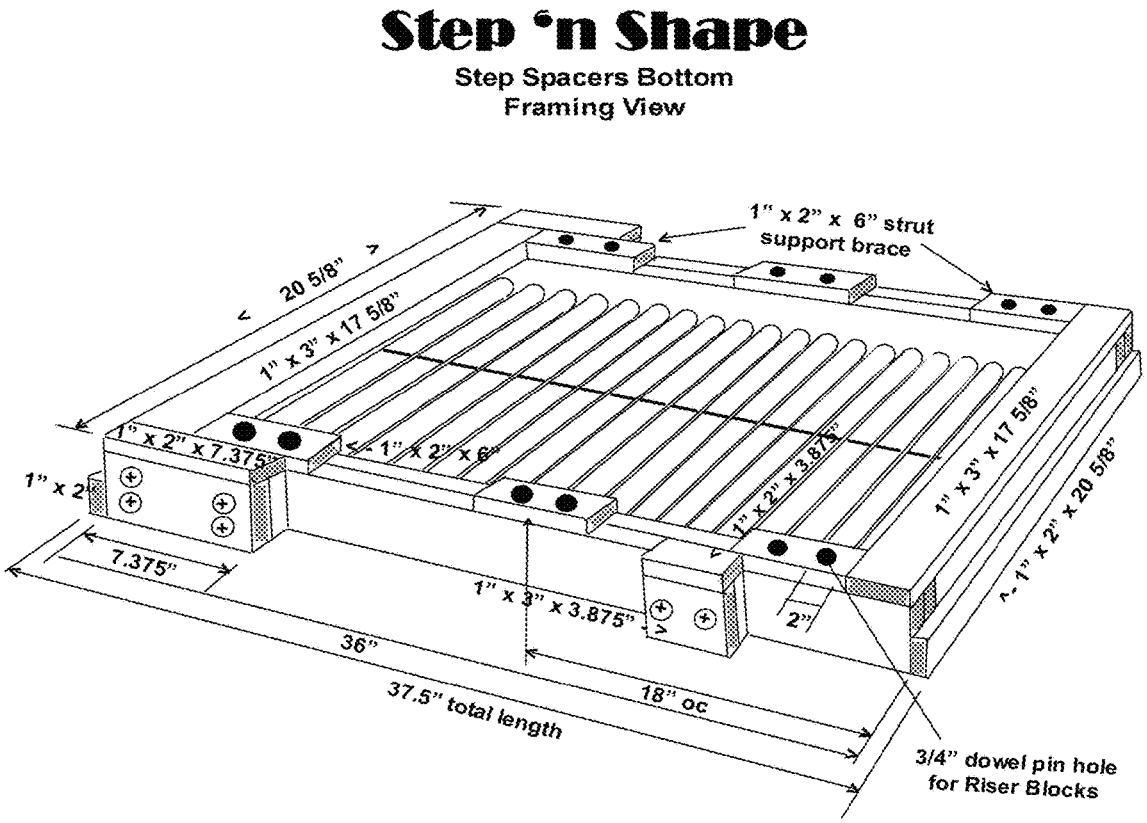

Figure #5:
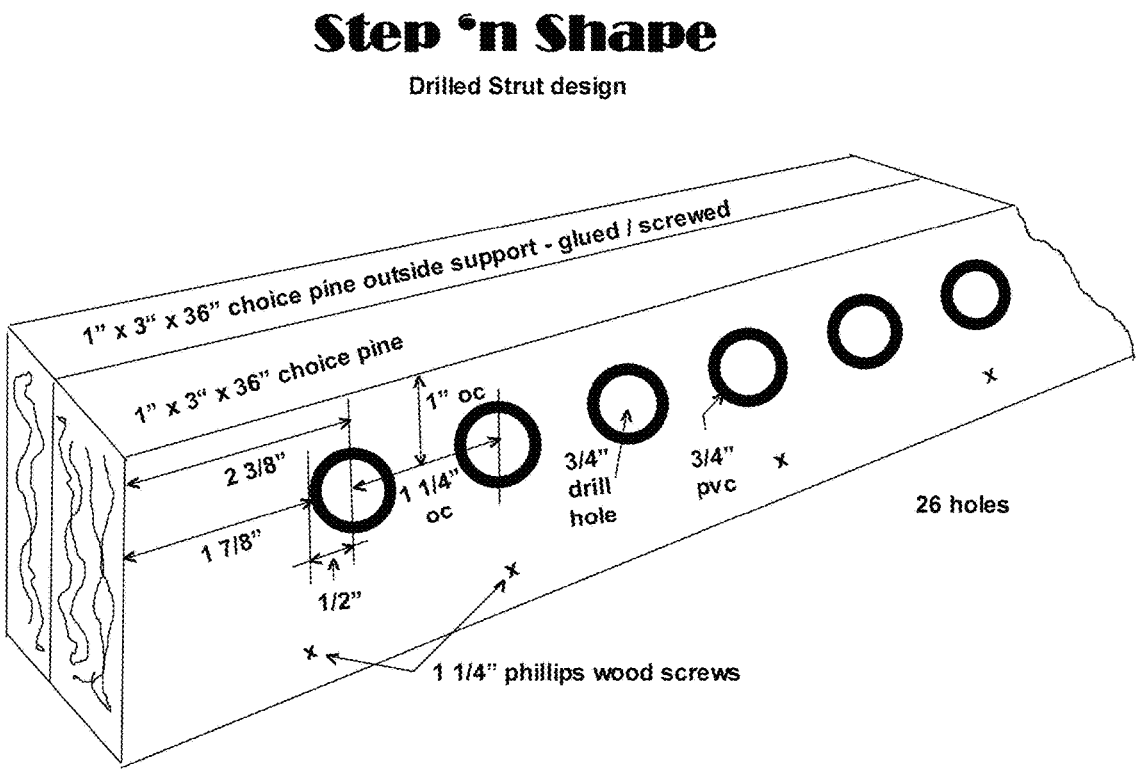

Figure #6:
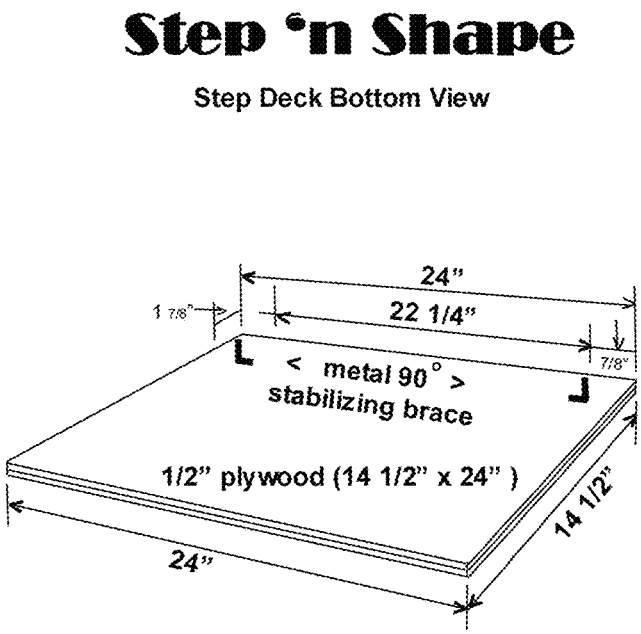

Figure #7:
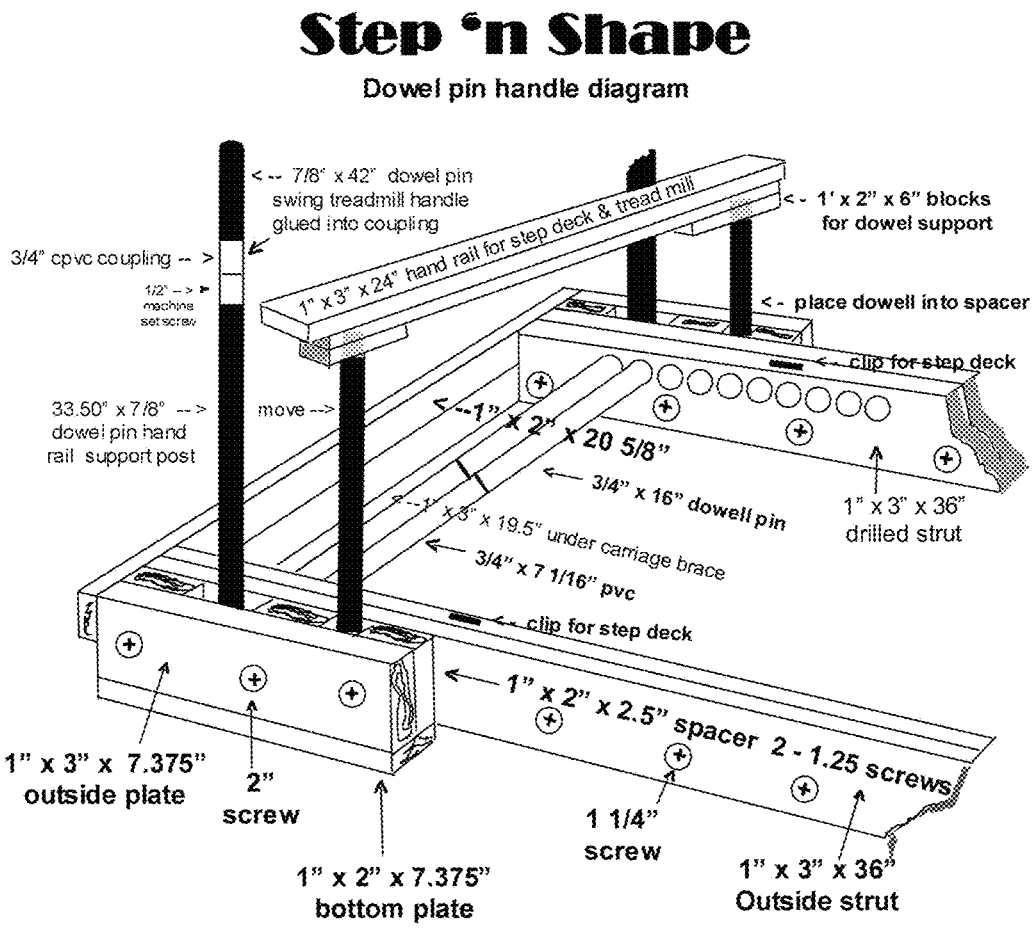

Figure #8:
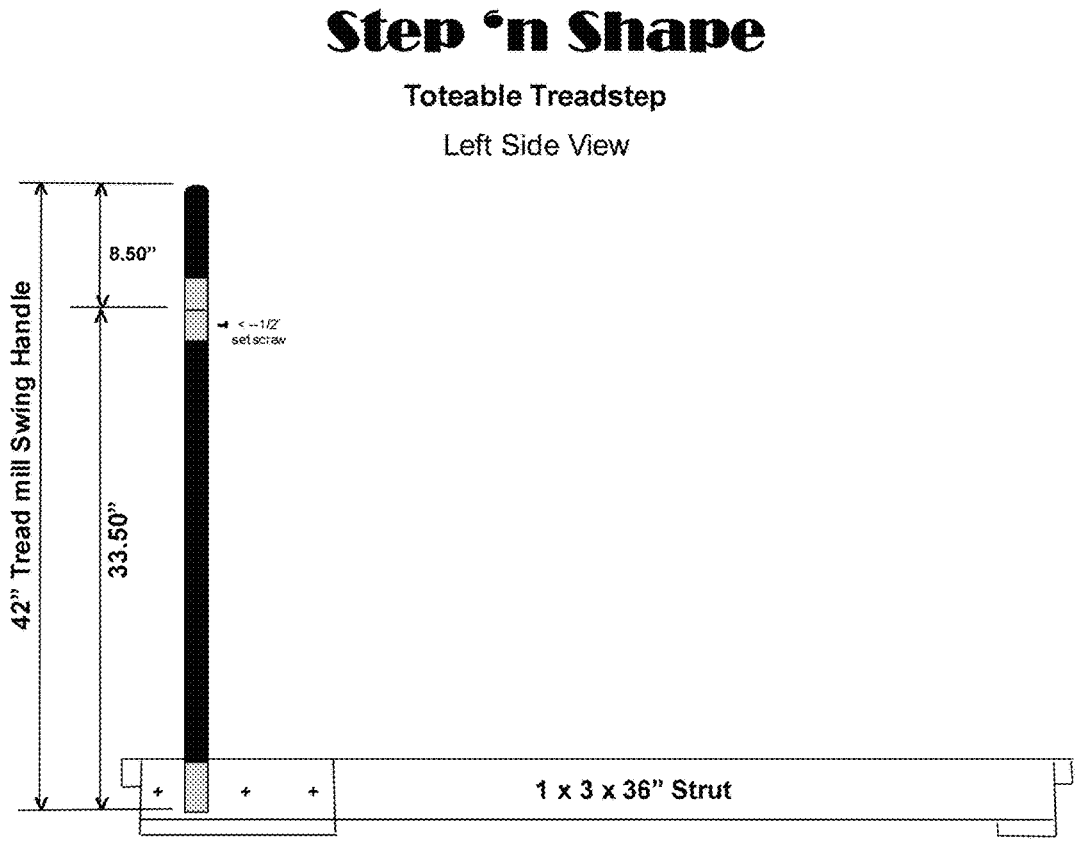

Figure #9:
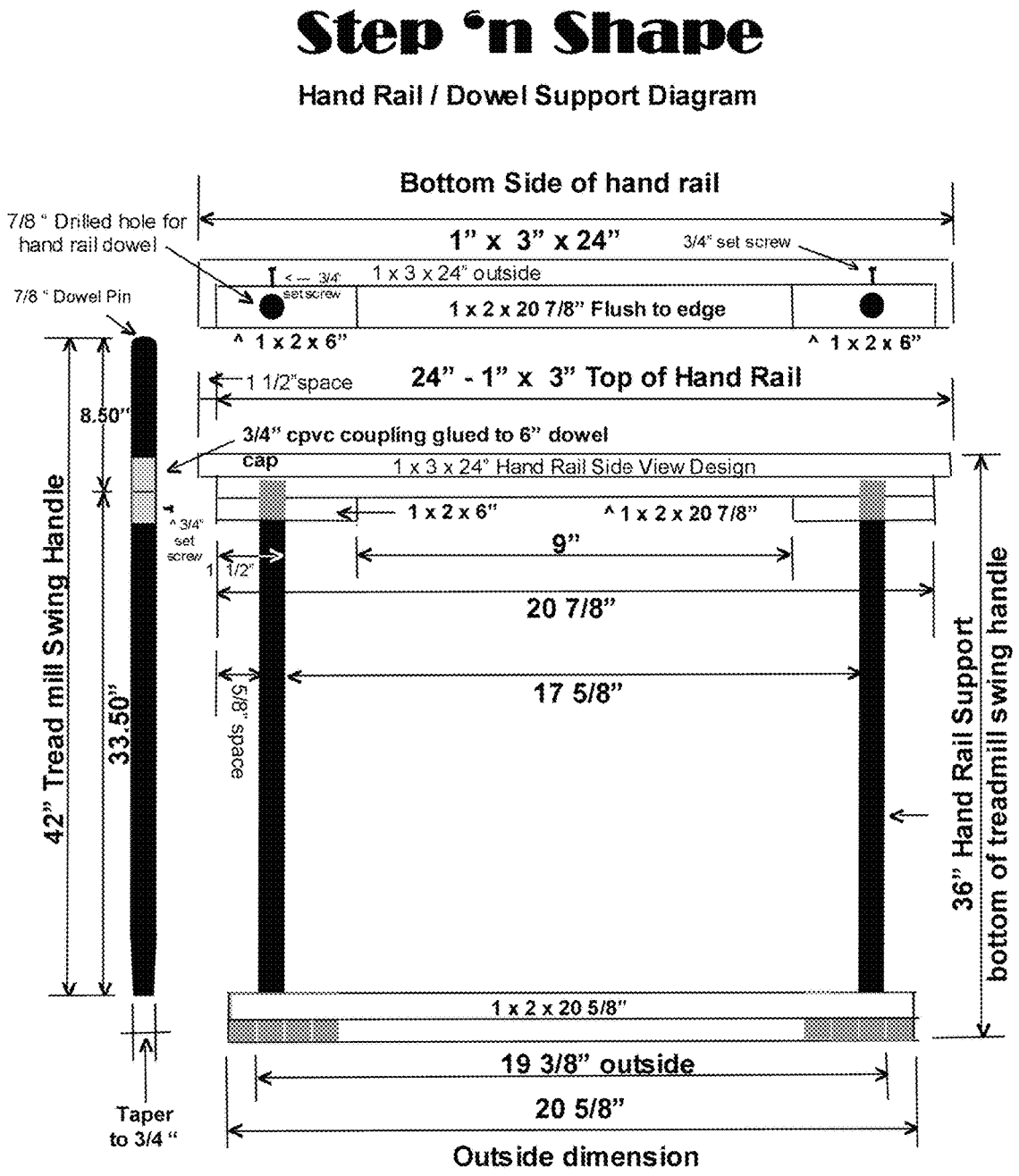

Figure #10:
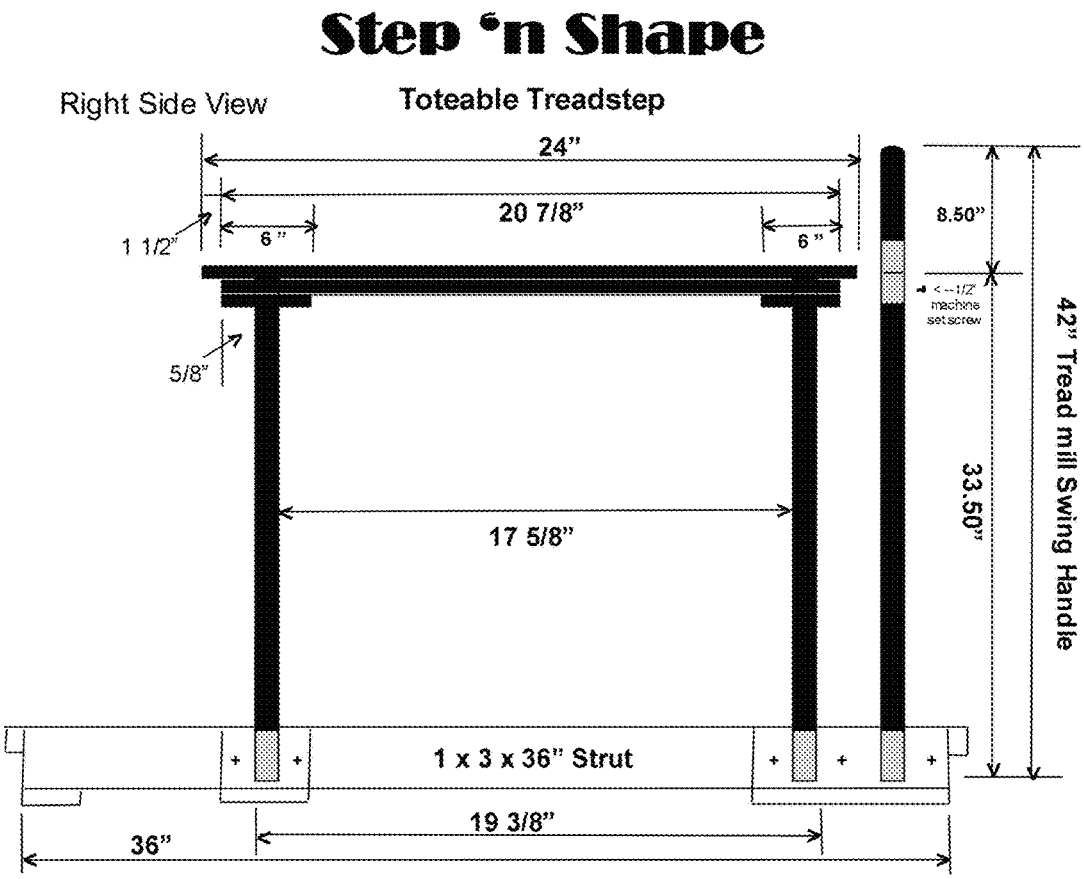

Figure #11:
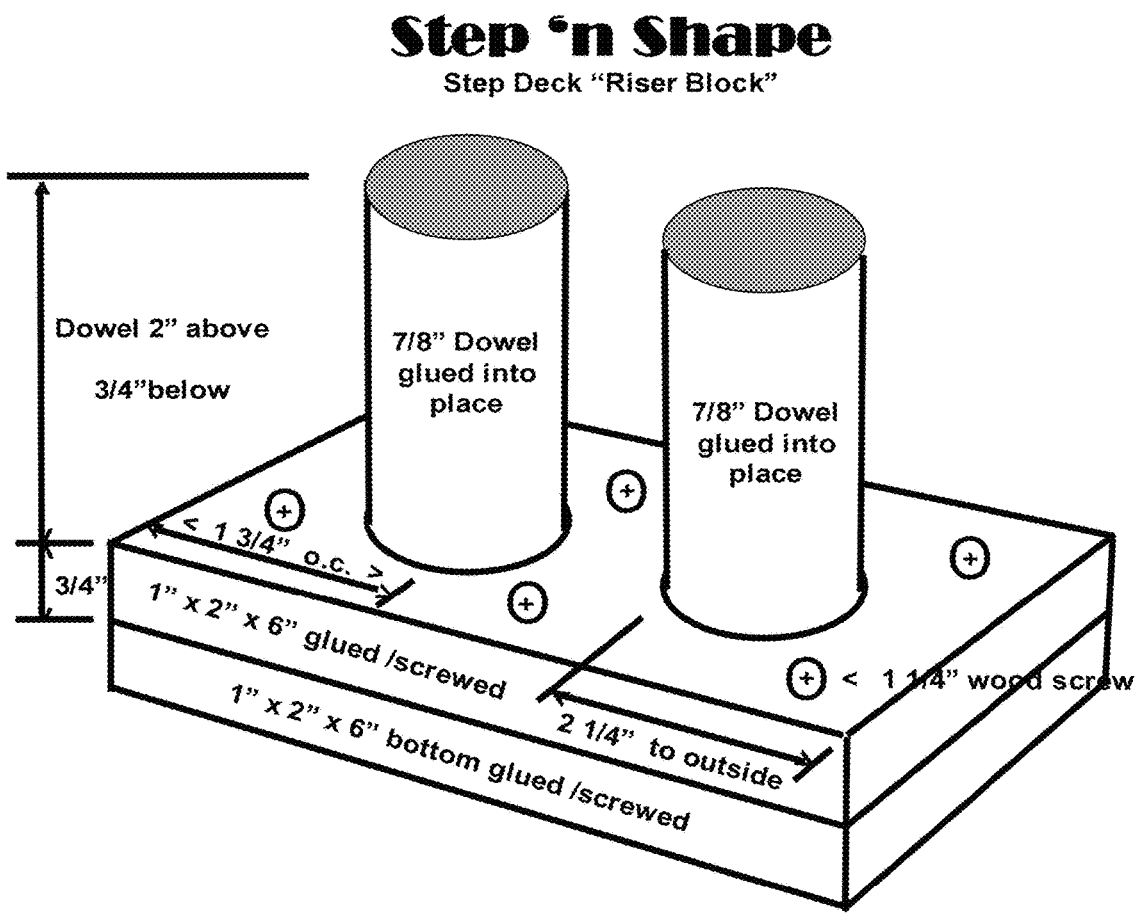

Figure #12:
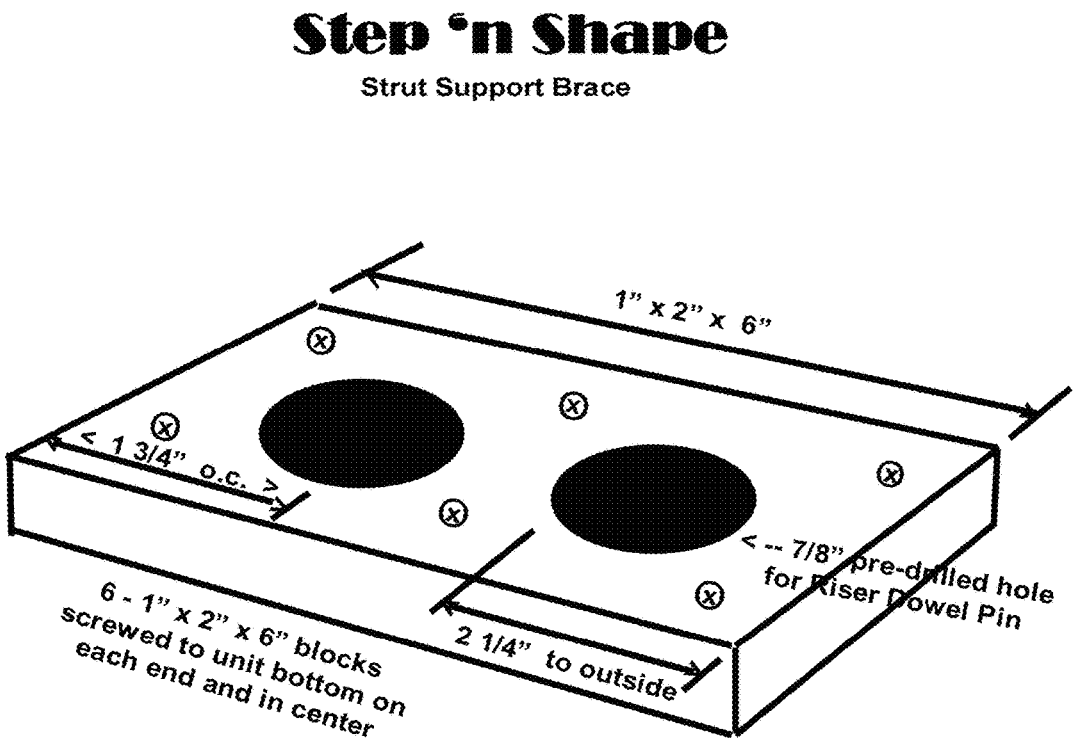

TOTEABLE TREADSTEP

BACKGROUND OF THE INVENTION

The design and creation of this device was to fulfill a need and desire for individuals to exercise inside protected from the elements and safe from danger; however, not restricted to an indoor application as it is portable. Developed for small space application (RV) with an adherence and restriction to size of the unit became the main concern in its design. It had to be small and compact in size, lightweight for mobility and storage but more importantly, sturdy, durable and able to withstand a rigorous workout from different types of individuals with varying weight and size.

The secondary goal of the product was to be inexpensive, to be an economical device that despite its small frame and appearance would actually work and last. Incorporating common everyday construction materials; wood and PVC pipe completed the intent design.

The final decree of the product was that it must deliver a heart healthy leg exercise with aerobic design to entice all; retired individuals with a fixed income that may even have limited mobility and the average income consumer who cannot and will not purchase the electrical, gear driven, computer monitored metallic giants readily advertised.

The device must offer a leg exercising supplemental simulation of walking, jogging, running and aerobic workout. An easy accessible, compact, convenient, portable device with no maintenance that's virtually indestructible. A treadmill device with the added benefit of a step deck conversion simulating stair climbing with optional riser blocks to increase the results or resistance of the stair step application. All components promoting a heart healthy aerobics leg exercising workout with an adherence and concern for safety with the inclusion of swing handles and handrail provide balance and safety. The swing handles also allow user arm movement similar to actual walking swing simultaneously with the use of the leg exercise treadmill device along with handrail stability for security while in step deck conversion application. Handles and handrail function as means of balance and stability for the user while performing multiple leg exercises available and utilized in this device by user.

Commonly seen and advertised are the huge monstrous, cumbersome, electrical, mechanical, and manual belt driven, gear driven, control resisted regulated efficient bearing mechanisms, computer monitored, and relatively stationary treadmill exercising workout devices. Unfortunately, these products are normally very expensive and, even though advertised as portable, they are primarily stationary due to size and weight, allotted space, and materials comprising the construction.

This product fulfills a mandatory need and desire by all, from the high dollar corporate executive to the average income consumer and retired fixed income individual's guarantying access and affordability to a commercially manufactured two in one device: treadmill with step deck conversion. A professional device that delivers supplemental simulation of walking, jogging, running and aerobics workout device activated by a manual step and drag leg exercise with added benefit of a step deck conversion simulate stair step climbing aerobics while in the security of a home, office, apartment, RV, hotel, enjoying a climate controlled atmosphere. In short, such a space saving non-obtrusive device that's lightweight, compact and affordable accomplishing the same desired results for pennies on the dollar delivering all of the above mentioned criteria is either non-existent or simply not available on the market today.

Another asset of this device is virtually no maintenance or replacement parts: motors, computers, resistors, metal rollers, belts, tension springs, etc. The "Toteable Treadstep" has no belts or motor to repair or parts to replace. In fact there are NO mechanical or electrical parts incorporated in the design of this device.

Some of the very expensive, demonstrative models advertised include computer monitors, programs with scenery of distant lands, heart monitors, device calculating speed and distance with resistance controls to "increase" the intensity of the workout. This is all wonderful, but inconvenient when exercising outdoors.

When user is engaged in an outdoor walk/jog they simply adjust the speed and/or distance of their walk/run for a more intense workout. The "Toteable Treadstep" device offers the same flexibility. There is no need for resistors, belts, tension springs. In a step and drag foot action, a user initiates motion regulating the intensity of their workout by speed and time utilized as with an outdoor event. For outside endeavors, small monitoring devices easily and conveniently attach to the individual's wrist or belt which is also applicable with this device whether the workout is at a home, office, RV, apartment, hotel, dorm, etc. As for monitors broadcasting faraway lands and goal assisted instructors, the unit can easily be set up and removed for a temporary application in front of a television with readily available instructional video's to complete the transition. There are very few, if any limitations as to where the user can engage in an exercising workout with this device.

There are so many patents of products each offering their own twist to their creative apparatus or to a pre-existing device that were discovered thru the archives of the United States Patent and Trademark Office dating back to the late 1800's and early 1900's. However, none of these devices duplicated the design, materials or matched completely the design, construction and/or intent of this device sometimes greatly differentiating in several aspects. Examples: U.S. Pat. Nos. 5,110,117, 5,407,408-A, 5,711,745-A or 6,132,343-A, and 4,757,987-A.

The intent of this product is to provide the exercising enthusiast a compact lightweight small sized portable movable structurally sound two in one treadmill/step deck conversion device that fits conveniently into small spaces (such as an RV, apartment, dorm room, hotel, office etc.) and easily transported by car, bus, boat for accessibility anytime, anywhere wherever and whenever user feels the incentive to exercise. This allows the user the flexibility of use anytime and virtually anywhere to conveniently walk, jog, run, step in shape, and stay healthy while in a safe and secure environment. The main intent of this product is to not be a big, invasive, cumbersome, gear driven, mechanical, electrical monster that costs hundreds if not thousands of dollars, but, instead, an inexpensive product of convenience that's lightweight, compact, long lasting, durable, workable, efficient, portable and affordable to all, a much needed product in today's market place.

FIELD OF THE INVENTION

The present invention relates generally to an exercise apparatus, and more particularly to a multi-purpose exercise device intended for use in doing a walking exercise and simulated stair climbing with swing handles assisted movement reminiscent to normal walking arm swing.

(1) Field of the Invention

482/54—Treadmill for foot travel: This subclass is indented under subclass 51. Subject matter wherein the muscle conditioning or developing apparatus is a movable surface, e.g., a roller, endless belt, etc., upon which the user may walk or run while remaining in essentially the same location relative to a fixed supporting surface.

482/52—Stair climbing: This subclass is indented under subclass 51. Subject matter wherein significance is attributed to conditioning or developing a muscle employed as the user ascends or descends a set of steps or operates apparatus which imitates ascending or descending a set of steps.

The "Toteable Treadstep" is a 2 in 1 exercising device designed to be a portable, manual treadmill exercising device that allows the user the advantage of exercising virtually anywhere at any time for weight loss and building leg muscles and easily converts from a treadmill to stair step device promoting a heart healthy cardio-vascular work out, benefitting both the heart and lungs.

SUMMARY OF THE INVENTION

An object of this invention is to provide the exercising enthusiast a workable lightweight compact rigidly designed economical two in one non-mechanical, manual treadmill with a step deck conversion device that is able to function in a small space readily available anytime and anywhere, facilitating the above needs by supplemental simulation of walking, jogging, running, and stair climbing aerobic leg exercises with swing handles and a handrail when in step deck conversion providing balance and stability for arm movement simultaneously with the use of the leg exercise.

A further object of this invention is to provide a universal exercise device which fulfills the above needs by supplemental simulation of leg exercises in aerobic workouts. Such a device which is safe and dependable with no replacement parts or assembly required components and no hinges or folding handles to store or move. Optional elements include swing handles and a handrail which ensure assisted balance and safety of user, as well as a riser assembly. All is an endeavor and intent of product to entice the exercising enthusiast by offering an inexpensive, small compact, well-built, portable, easily accessible device designed to initiate implementation of a heart healthy leg exercising and aerobic workout.

In accordance with this invention, the exercise device simulates walking, jogging, and running and is a leg exercise unit having plurality of non-metallic pipe rollers providing a foot contact surface. Furthermore, in accordance with this invention is a step deck conversion to simulate stair climbing by providing a deck platform for aerobic leg exercise. A pair of swing handles are wedged completely into specifically designed receiving slots by means of the handle/handrail assembly mounted on exterior front of opposite strut beams of each side of the foot contact surface with user pivoting the swing handles back and forth simultaneously with leg exercise with said handles offering balance and stability thus providing a normal arm swing motion with leg exercise during use of the leg exercise unit.

The leg exercise device includes a handrail for balance held by the user's hand during the stair step conversion aerobic leg exercise. In the preferred practice of this invention, the user's momentum of step and drag foot action on said plurality rotatably rollers deemed treadmill regulates the speed and intensity of workout, describing device as a manual treadmill.

The step deck conversion offers an easily modified benefit of stair climbing simulated aerobics workout. For a more invigorating and heart healthy cardio-vascular aerobics work out, riser blocks and corresponding riser plates provide an optional raising of the entire unit, promoting higher knee lifts ensuing a more intense aerobics workout.

In a preferred design, the device is a two in one treadmill/step deck conversion product that's sturdy, durable and able to withstand a rigorous workout from different types of individuals with varying weight and size (tested 6'4" at 230 lbs.) fitting conveniently in small spaces (such as: RV, apartment, dorm room, hotel, office etc.) and easily transported by car, bus, boat for accessibility anytime, anywhere. Ease of storage and transportation of the device is facilitated by gripping the handle bars located on opposite end of device attached perpendicular to each strut beam or by simply gripping strut beam with nothing to fold or disassemble, completing the intent of all needs and desires.

BRIEF DESCRIPTION OF THE DRAWINGS

FIG. 1 is a complete overall perspective view of the toteable treadstep with a plurality non-metallic rotatably rollers threaded over dowels rods with swing handles positioned in specifically designed slots wedged firmly in mounted handle/handrail assembly for assisted balance and stability while ensuring a normal arm swing. A handrail is shown for clarity in optional position for treadmill application but is placed perpendicular to strut beams when in step deck conversion. A deck platform shown with locking clips pivoting over deck when deck is positioned on top of treadmill rollers with step deck conversion selectively in an operative location with treadmill in a storage location.

FIG. 2 is a top plan view of the device shown in FIG. 1 in the form of a treadmill having exterior strut beams, plurality of pipe rollers, handle/handrail mounted assembly, rear handrail mounted assembly, and a step deck platform locked down with pivoting clips, with handle bar mounted perpendicular to parallel strut beams and underneath carriage plate referenced.

FIG. 3 is a perspective view of FIG. 1 without swing handles, handrail, or riser blocks.

FIG. 4 is a perspective bottom plan view of the device shown in FIG. 1 and FIG. 3 in the form of a treadmill with an inner strut with evenly spaced holes for receptive multiple spaced dowel pins secured to exterior strut comprising a rigid strut beam frame unit with equally dimensioned dual non-metallic hollow pipe rollers threaded over said dowel pins, perpendicular carriage plate brace, a handle bar, and strut supportive riser block plates.

FIG. 5 is a perspective view of the device FIG. 1 showing the inner strut having evenly spaced holes for reception of multiple spaced dowel pins and being secured to exterior strut to form a rigid strut beam frame. The hole alignment is critical for smooth rolling application when in active treadmill operation.

FIG. 6 is a perspective plan bottom view of the device shown in FIG. 1 step deck with metal corner bracket placement.

FIG. 7 is a perspective view partly in section of a portion of the device in FIG. 1 with swing handles and handrail in normal operating position, with dowel swing handle and bottom of swing handle dowel doubling for handrail post secure in handle/handrail mounted assembly.

FIG. 8 is a left side view of frame and swing handle secured in handle/handrail assembly mounted on exterior of front end of strut beam with grey tones depicting tapered bottom section of swing handle intersecting housing bottom plate shown in FIG. 1 and FIG. 4.

FIG. 9 is a frontal view of the device frame with the handrail in a perpendicular operative placement secured in handle/handrail assembly mounted on front end of exterior side. Each strut beam showing grey tones depicting ends of the frame and ends of handle/handrail assembly outside plate and spacer. The bottom section of swing handles doubling as handrail support post with tapered end wedged down until intersection of housing bottom plate. The side and bottom view of handrail design with holes to receive top end of handrail post, and swing dowel handle joined by a cpvc coupling with set screw to comprise a fully assembled one piece swing handle.

FIG. 10 is a right side view of the device shown in FIG. 1 with a swing handle wedge mounted in the handle/handrail assembly until intersection of a housing bottom plate and handrail in optional operative use—wedged in front mounted handle/handrail assembly and rear mounted handrail assembly.

FIG. 11 is a perspective view of riser blocks with an upper and lower plate joined together for inserted and secured equal length dowel pins with equal spacing from edge to center.

FIG. 12 is a perspective view of the device shown in FIG. 3 riser block plate mounted to bottom of strut beam strategically spaced for optimum structural integrity of beam.

DETAILED DESCRIPTION

The present invention is intended to provide a compact lightweight small sized portable movable structurally sound two in one treadmill/step deck conversion device supplemental simulate leg exercises and stair climb aerobic workouts. The main function of the device is to provide a safe and dependable apparatus with no replacement parts or assembly required components, no hinges or folding handles for storing or moving.

Optional elements such as swing handles (1, 2, 3) and handrail (4, 5, 6) insuring user assist balance and safety. The pair of swing handles (FIG. 1, 7, 8, 9, 10), which would be held by the user's hands, are selectively pivoted to provide a natural arm swing simultaneously with the leg exercise as well as means of balance and stability while user engages in leg exercise.

The step deck conversion (FIG. 1, 2, 3, 6) supplements simulation of stair climbing aerobic workout includes a handrail (FIG. 7, 9) which would be held by the user's hand providing balance and security while performing an invigorating cardio-vascular aerobic leg exercise workout.

Riser plates on bottom of strut beam for structural purposes also correspond to riser blocks (FIGS. 11-2) lifting the entire unit higher such that knee lifts insure a more intense aerobics workout.

As shown in FIG. 1 the device comprises a multi-purpose exercise apparatus with implied usage by means of easy access, compactness, lightweight and affordable design. Composed with a lightweight rigid exterior frame (18), horizontal dowel pins (16) with equally dimensioned dual hollow tube (8) threaded over each dowel pin (16) in need prevention of stalling and interference of foot motion once feet become parallel to one another in walking pattern. Swing handles comprise an upper (3) and lower section (1) joined by a cpvc coupling (2) with set screw (27) as shown in FIG. 9. Upper section (3) is permanently inserted in upper part of coupling (3). A smooth and rounding curvature (29) of top of upper section (2), FIG. 9 provides comfortable hand grip. Swing handles (FIG. 9) wedged in mounted handle/handrail assembly (11) to exterior front opposite side of strut beam (18) pivot back and forth in specifically design slots (19) allowing normal arm swings as well as stability and balance for user. Swing handles lower section (1) serves multiple usages with bottom part interchangeable as support brace in handrail (FIG. 9). Handrail construction is notated in FIG. 9 with support brace (5) to the smooth to touch top plate (4) with receptive post plates (6).

The assembled handrail design (4, 5, and 6) is complete with attention to receiving holes for support post, must be in alignment for reception of bottom part of swing handle (1) insertion until intersection of bottom side of top plate (4) of handrail (FIG. 9). Set screws lock handrail securely to support post (1) for step deck conversion operation.

The versatility of device and added benefit is its transformation from treadmill (FIGS. 1, 2 and 3) to a step deck (9) for supplemental simulation of a stair climbing aerobic workout. Pivotal clips (10) attached to top of inner strut (17) anchor step deck (9) into place. Inner strut beams hole placement (FIG. 5) requires strict adherence to holes alignment as to horizontal distance from center to center of dowel and hollow tube (8) thicknesses with both calculations combined in order to achieve a smooth roller foot contact surface when in active treadmill operation. The same calculation is mandated for strategic vertical step deck (9) placements procuring an uninterrupted perfectly level and evenly alignment of step deck (9) to top of inner strut beam for a safe stair stepping aerobic exercise when step deck (9) conversion is in active operation. For added concern, safety and protection to the user, FIG. 6 shows the bottom side of step deck (9) having two 90 degree metal brackets permanently affixed with bracket appendage slipping completely thru and between dowels 16 with rollers (8) locking step deck (9) firmly into place with pivoting clips on top and brackets underneath.

To further entice the "not so much" exercising enthusiast or a prod motivation for the reluctant user to enter into a healthy exercising regiment, the device offers the ease of accessibility. Although easily stowed and out of sight, The "Toteable Treadstep" is extremely mobile and versatile due to its lightweight construction components and compact size.

A horizontal smooth to touch handle bar permanently attached perpendicular to each end of each strut beam with a flush edge to edge joining to top of said strut beams allows ease of lift, maneuverability, and transporting. Furthermore, the compact design is based on a stride regulated in military and marching band of a 30" pace, or stride with treadmill proportioned to accommodate an even longer stride without fear of running out of plurality of roller foot contact surface area. As to the horizontal plurality of rollers foot contact surface the unit is of standard industry width.

As an added incentive to manifest and induce even greater results, riser blocks (FIG. 11) are constructed in a similar fashion with conformity to design of device. Two stabilizing protruding dowel pins of equal perpendicular appendage (35) are equally spaced on center from end edges (34) and centered to width to be permanently fastened in the hole plate with the hole plate permanently joined to bottom plate (FIG. 12). Attention to hole alignment in structurally spaced support riser plates to reciprocate and coordinate dowel pins for consummation (FIG. 11). This raises the entire unit to a safe but higher level, perpetuating an even higher knee lift for simulate stair climbing activity resulting in a more invigorating, heart healthy, cardio-vascular aerobic workout when in step deck conversion operation.

The "Toteable Treadstep" has adaptable modifications such as a workbench with an adjustable support brace for weights when user is engaged in a regiment of upper body strength training and torso muscle building and toning. The options are not really limited for this simple but efficient compact but economical portable but durable little device to grow and grow becoming a complete exercising arena.

The invention claimed is:

1. A dual purpose, non-mechanical, portable strength training apparatus for simulating walking, jogging, or running, the apparatus comprising:

a. a strut beam frame with two inner struts having evenly spaced receiving holes attached to exterior strut outer plates, said outer plates comprising rigid strut beams;

b. a plurality of solid rods extending transversely and secured in respective receiving holes of said inner struts and defining an exposed length;

c. a plurality of rollers threaded over said plurality of solid rods along to constitute a manually operated rotatable foot contact surface; each roller comprising two sections of hollow tubing of equal dimension spaced apart on a respective solid rod of the plurality of solid rods and substantially covering the exposed length of said solid rod; each section of each roller configured to function independently of each other such that each section rotates about the solid rod in response to a user's step and drag foot action;

d. a horizontal handle bar attached perpendicular to an front end of each strut beam for portability;

e. a carriage plate fastened perpendicular to a bottom side of each end of each strut beam and a support plate mounted midway along each beam for beam structural integrity and to allow of movement of said rollers; wherein the beam frame, solid rods, handle bar and carriage and support plates form a rigid rectangular treadmill frame; and f. handle assemblies mounted on opposite exterior front sides of strut beams; said handle assemblies having slots receiving a swing handle which is configured to pivot back and forth in respective said handle assemblies to function as means of natural arm movement utilized in walking and jogging as well as balance and stability for user.

2. The device of claim 1, further comprising a step deck conversion for supplemental stair climbing aerobic leg exercise, said step deck comprising a removable deck platform placed over said plurality rollers between said inner struts and securely fastened to said inner struts by pivoting rotatable clips mounted on top of said inner struts and 90 degree non-movable metal brackets fastened to a bottom side of said deck platform with a bracket appendage of the metal brackets placed between two sets of adjacent rollers of the plurality of rollers to prevent rolling and misalignment of said deck platform.

3. The device of claim 1, wherein each said swing handle further comprises:

a vertical post having upper and lower sections of unequal dimension unified as one piece by coupling using a set screw; said lower section having a tapered bottom end to be secured completely in said handle assembly.

4. The device of claim 1, further comprising a handrail comprising:

a. a top plate secured to a bottom handrail support brace and support post receiver plate having support post receiving holes;

b. a support post, engaged within said support post receiving holes.

5. The device of claim 1, further comprising a plurality of riser assemblies mounted to a bottom of each strut beam, each riser assembly comprising:

a. riser blocks having a perpendicular rod protrusion;

b. riser plates having receiving holes configured to receive said protrusion of said riser blocks.

* * * * *